US008436774B2

(12) United States Patent
Wong et al.

(10) Patent No.: US 8,436,774 B2
(45) Date of Patent: May 7, 2013

(54) MOBILE COMMUNICATION DEVICE

(75) Inventors: Kin Lu Wong, Kaohsiung (TW); Ming Fang Tu, Hsinchu (TW); Chun Yih Wu, Taipei (TW); Wei Yu Li, Yilan (TW)

(73) Assignees: Industrial Technology Research Institute, Chutung, Hsinchu (TW); National Sun Yat-Sen University, Kaohsiung (TW)

( * ) Notice: Subject to any disclaimer, the term of this patent is extended or adjusted under 35 U.S.C. 154(b) by 339 days.

(21) Appl. No.: 12/872,450

(22) Filed: Aug. 31, 2010

(65) Prior Publication Data

US 2011/0122027 A1 May 26, 2011

Related U.S. Application Data

(60) Provisional application No. 61/263,938, filed on Nov. 24, 2009.

(51) Int. Cl.
*H01Q 1/38* (2006.01)
*H01Q 5/00* (2006.01)
*H01Q 9/04* (2006.01)

(52) U.S. Cl.
USPC ..... 343/700 MS

(58) Field of Classification Search ..... 343/700 MS
See application file for complete search history.

(56) References Cited

U.S. PATENT DOCUMENTS 7,932,865 B2 * 4/2011 Wong et al. ..... 343/702
7,978,141 B2 * 7/2011 Chi et al. ..... 343/741
2004/0008141 A1 1/2004 Sato et al.
2004/0233109 A1 * 11/2004 Ying et al. ..... 343/700 MS
2007/0257842 A1 11/2007 Tseng
2008/0100516 A1 * 5/2008 DiNallo et al. ..... 343/702
2008/0278377 A1 11/2008 Vance
2009/0273530 A1 11/2009 Chi et al.
2010/0328164 A1 * 12/2010 Huynh ..... 343/702

(Continued)

FOREIGN PATENT DOCUMENTS

CN 1318879 A 10/2001
CN 1469672 A 1/2004

(Continued)

OTHER PUBLICATIONS

Full European Search Report for corresponding Application No. EP 10189359.2 for search completed May 20, 2011.

(Continued)

*Primary Examiner* — Shawki Ismail
*Assistant Examiner* — Dylan White
(74) *Attorney, Agent, or Firm* — Egbert Law Offices, PLLC

(57) ABSTRACT

A mobile communication device includes a ground plane and an antenna. The antenna is disposed on a dielectric substrate and includes a radiating metal portion, a coupling metal portion, and an inductive shorting metal portion. The radiating metal portion provides a resonant path for the antenna to generate first and second operating bands. The coupling metal portion is coupled to the radiating metal portion to form a first coupling portion and is connected to a source through a connecting metal strip. One end of the inductive shorting metal portion is electrically connected to the radiating metal portion, and the other end is electrically connected to the ground plane. The inductive shorting metal portion includes a first fractional section coupled to the radiating metal portion to form a second coupling portion, and a second fractional section coupled to the coupling metal portion to form a third coupling portion.

21 Claims, 5 Drawing Sheets

U.S. PATENT DOCUMENTS

| | | | | |
|---|---|---|---|---|
| 2011/0095949 | A1* | 4/2011 | Wong et al. | 343/702 |
| 2011/0102272 | A1* | 5/2011 | Wong et al. | 343/702 |
| 2011/0227806 | A1* | 9/2011 | Wong et al. | 343/848 |
| 2012/0001815 | A1* | 1/2012 | Wong et al. | 343/749 |
| 2012/0062434 | A1* | 3/2012 | Kim et al. | 343/749 |

FOREIGN PATENT DOCUMENTS

| | | | |
|---|---|---|---|
| CN | 101138130 | A | 3/2008 |
| EP | 1143558 | A2 | 10/2001 |
| EP | 2117073 | A1 | 11/2009 |
| TW | I295517 | | 4/2008 |
| WO | 2006097918 | A2 | 9/2006 |

OTHER PUBLICATIONS

Partial European Search Report for corresponding Appication No. EP 10 18 9359 for search completed Feb. 28, 2011.

Juha Villanen, Clemens Icheln, and Pertti Vainikainen, a Coupling Element-Based Ouadbandantenna Structure Formobile Terminals, Microwave and Optical Technology Letters / vol. 49, No. 6, Jun. 2007, pp. 1277-1282.

Juha Villanen and Pertti Vainikainen, Optimum Dual-Resonant Impedance Matching of Coupling Element Based Mobile Terminal Antenna Structures, Microwave and Optical Technology Letters / vol. 49, No. 10, Oct. 2007, pp. 2472-2477.

Kin-Lu Wong and Chih-Hong Huang, Printed PIFA With a Coplanar Coupling Feed for Penta-Band Operation in the Mobile Phone, Microwave and Optical Technology Letters / vol. 50, No. 12, Dec. 2008 , pp. 3181-3186.

SIPO Search Report dated Dec. 13, 2012 in Chinese.

Excerpt English translation of SIPO Search Report dated Dec. 13, 2012.

* cited by examiner

MOBILE COMMUNICATION DEVICE

CROSS-REFERENCE TO RELATED APPLICATIONS

The present application claims priority from U.S. Provisional Patent Application Ser. No. 61/263,938, filed on Nov. 24, 2009.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The disclosure relates to a mobile communication device. More particularly, the disclosure relates to a mobile communication device capable of broadband or multiband operation.

2. Description of Related Art Including Information Disclosed Under 37 CFR 1.97 and 37 CFR 1.98.

Because of the demand of increasing the capacity and speed of mobile telephone networks for mobile users, the long term evolution (LTE) system has been proposed. The LTE system could provide better mobile broadband and multimedia services than the existing GSM/UMTS mobile networks so it is expected to be very attractive for the mobile users in the near future. Besides, the LTE system could also support the existing GSM/UMTS operation; this makes ubiquitous mobile broadband coverage very promising to become a reality. For this application, a mobile communication device equipped with a compact antenna which can cover the LTE/GSM/UMTS operation has become an important research topic recently. However, it is difficult to design a single internal antenna to cover the required wide bandwidth (698~960 MHz and 1710~2690 MHz) of the operating bands for the LTE/GSM/UMTS operation in a mobile communication device which generally offers limited space for internal antennas. In view of the bandwidth of the operating bands of the antennas used in the current mobile communication devices, most of them could not achieve the bandwidth requirement for the LTE/GSM/UMTS operation. The multiband operation could be achieved by designing an open loop antenna integrated with an additional shorted parasitic monopole strip; however, the operating bands of the antenna cover only GSM900/GSM1800/GSM1900/UMTS systems for quad-band operation. Although adding an additional shorted parasitic monopole strip for an antenna could provide an additional resonant path for generating a new resonant mode to improve the operating bandwidth of the antenna, such a design approach would increase the required size of the antenna.

BRIEF SUMMARY OF THE INVENTION

To solve the problems of the above-mentioned prior art, the present embodiment discloses a mobile communication device, which includes an antenna capable of wideband and multiband operation. The antenna uses a radiating metal portion short-circuited to a system ground plane through a long inductive shorting metal portion. The antenna could be capable of generating two wide operating bands.

According to one embodiment, a mobile communication device includes a ground plane and an antenna. The antenna is disposed on a dielectric substrate. The antenna comprises a radiating metal portion, a coupling metal portion, and an inductive shorting metal portion. The radiating metal portion provides a resonant path for the antenna to generate a first operating band and a second operating band. The operating frequencies of the first operating band are lower than the operating frequencies of the second operating band. The coupling metal portion is coupled to the radiating metal portion to form a first coupling portion. The coupling metal portion is electrically connected to a source through a connecting metal strip. The coupling metal portion could capacitively couple the electromagnetic energy to the radiating metal portion through the first coupling portion. The inductive shorting metal portion has a length no less than one-half the length of the radiating metal portion. One end of the inductive shorting metal portion is electrically connected to the radiating metal portion and the other end of the inductive shorting metal portion is electrically connected to the ground plane. The inductive shorting metal portion includes a first fractional section coupled to the radiating metal portion to form a second coupling portion, and a second fractional section coupled to the coupling metal portion to form a third coupling portion.

BRIEF DESCRIPTION OF THE SEVERAL VIEWS OF THE DRAWINGS

The accompanying drawings, which are incorporated in and constitute a part of this specification, illustrate embodiments of the disclosure and, together with the description, serve to explain the principles of the invention.

DETAILED DESCRIPTION OF THE INVENTION

Figure 1:
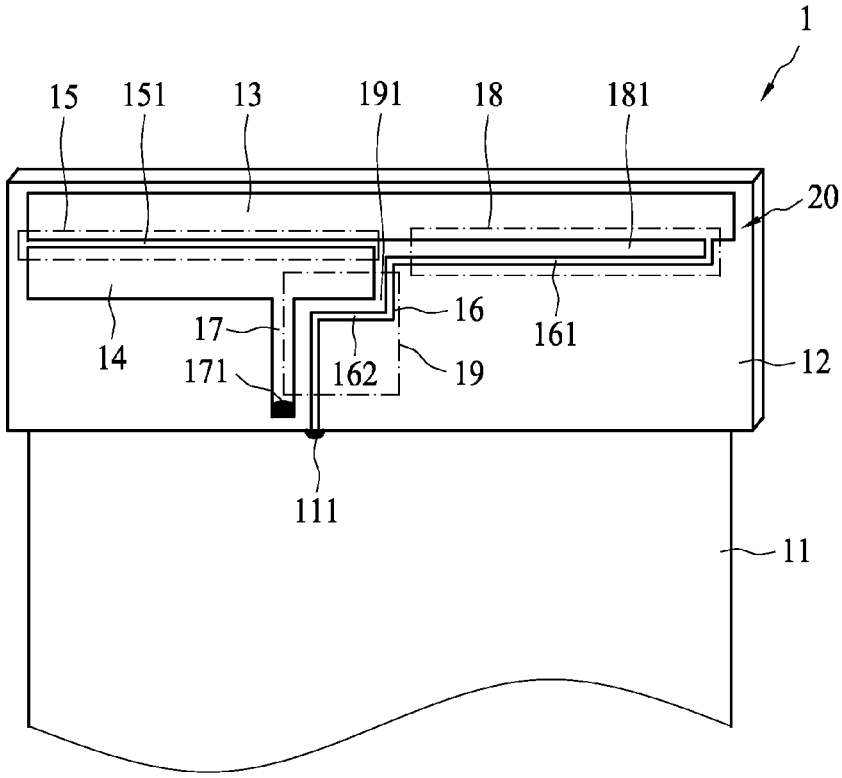
FIG. 1 illustrates a schematic view of one embodiment of the mobile communication device 1.

FIG. 1 discloses a schematic view of one exemplary embodiment of the mobile communication device 1, which includes a ground plane 11 and an antenna 20. The ground plane 11 has a grounding point 111. The antenna 20 is printed, etched, or injection molded on a surface of a dielectric substrate 12. The antenna 20 comprises a radiating metal portion 13, a coupling metal portion 14, and an inductive shorting metal portion 16. The radiating metal portion 13 is capacitively coupled to the coupling metal portion 14 to form a first coupling portion 15 having a coupling slit 151. In other words, the first coupling portion 15 includes at least one coupling slit 151. The coupling metal portion 14 is electrically connected to a connecting metal strip 17. One end 171 of the connecting metal strip 17 is electrically connected to a source (not shown). One end of the inductive shorting metal portion 16 is electrically connected to the radiating metal portion 13. The other end of the inductive shorting metal portion 16 is electrically connected to the grounding point 111 of the ground plane 11. The inductive shorting metal portion 16 includes a first fractional section 161 coupled to the radiating metal portion 13 to form a second coupling portion 18 having a coupling slit 181, and a second fractional section 162 coupled to the coupling metal portion 14 to form a third coupling portion 19 having a coupling slit 191.

Figure 2:
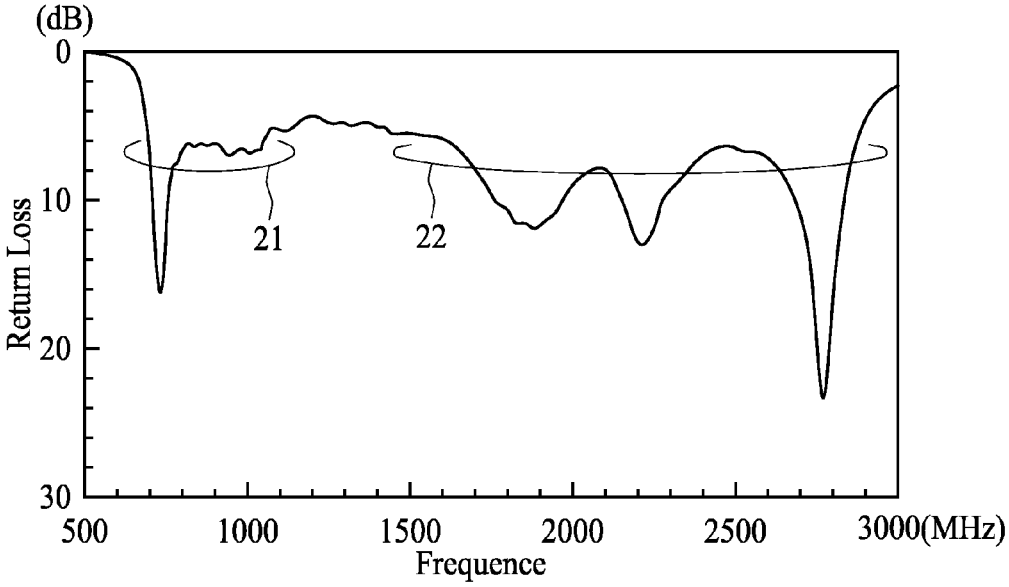
FIG. 2 illustrates a diagram of measured return loss of the mobile communication device 1 shown in FIG. 1.

FIG. 2 illustrates a diagram of measured return loss of the mobile communication device 1 as shown in FIG. 1. In this exemplary embodiment, dimensions of components of the mobile communication device 1 are as follows:

The length of the ground plane 11 is about 100 mm, the width thereof is about 45 mm; the height, width, thickness of the dielectric substrate 12 are about 15 mm, 45 mm, and 0.8 mm, respectively; the length of the radiating metal portion 13 is about 45 mm, the width thereof is about 3 mm, wherein the length of the radiating metal portion 13 is smaller than one-sixth of the wavelength of the lowest operating frequency (698 MHz) of the first operating band 21 of the antenna 20; the length of the coupling metal portion 14 is about 22 mm, the width thereof is about 3 mm, wherein the length of the coupling metal portion 14 is about half the length of the radiating metal portion 13. The length of the coupling metal portion 14 could be further reduced, but the length of the coupling metal portion 14 should be greater than one-third of the length of the radiating metal portion 13 to achieve a wider operating bandwidth for the first operating band 21. The gap of the coupling slit 151 between the coupling metal portion 14 and the radiating metal portion 13 is about 1 mm. The gap of the coupling slit 151 should be less than or equal to one percent of the wavelength of the lowest operating frequency of the first operating band 21 so as to provide sufficient capacitive coupling for the antenna 20. The length of the inductive shorting metal portion 16 is about 37 mm; its length could be further reduced, but it should be at least half the length of the radiating metal portion 13 so as to provide sufficient inductance for the antenna 20, so that several excited higher-order resonant modes of the antenna 20 could be effectively frequency down-shifted. The width of the inductive shorting metal portion 16 is about 0.5 mm. The smaller width of the inductive shorting metal portion 16 could further reduce the required length of the inductive shorting metal portion 16 to obtain a smaller antenna size and provide higher inductance for the antenna 20. The gap of the coupling slit 181 between the first fractional section 161 of the inductive shorting metal portion 16 and the radiating metal portion 13 is about 1 mm. The gap of the coupling slit 181 should be less than or equal to one percent of the wavelength of the lowest operating frequency of the first operating band 21 so as to provide sufficient capacitive coupling for the antenna 20. The length of the first fractional section 161 is about 20 mm. The length of the first fractional section 161 should be greater than one-fifth of the length of the radiating metal portion 13 so as to allow the second coupling portion 18 to form sufficient coupling for the antenna 20 so that a more uniform surface current distribution on the radiating metal portion 13 could be obtained to further enhance the bandwidth of the resonant modes of the antenna 20. The gap of the coupling slit 191 between the second fractional section 162 of the inductive shorting metal portion 16 and the coupling metal portion 14 is about 1 mm to form capacitive coupling so as to improve the impedance matching to enhance the operating bandwidth of the resonant modes of the antenna 20. The gap of the coupling slit 191 should be less than or equal to one percent of the wavelength of the lowest operating frequency of the first operating band 21. The length of the connecting metal strip 17 is about 8.5 mm, and the width of the connecting metal strip 17 is about 1.5 mm. From the experimental results, based on the 6 dB return loss definition acceptable for practical application, the first operating band 21 is capable of covering three operating bands, including the LTE700/GSM850/GSM900 bands (698~787/824~894/880~960 MHz). The second operating band 22 is capable of covering five operating bands, including GSM1800/GSM1900/UMTS/LTE2300/LTE2500 bands (1710~1880/1850~1990/1920~2170/2300~2400/2500~2690 MHz), so that the antenna 20 of the mobile communication device 1 could cover eight operating bands for the LTE/GSM/UMTS operation.

Figure 3:
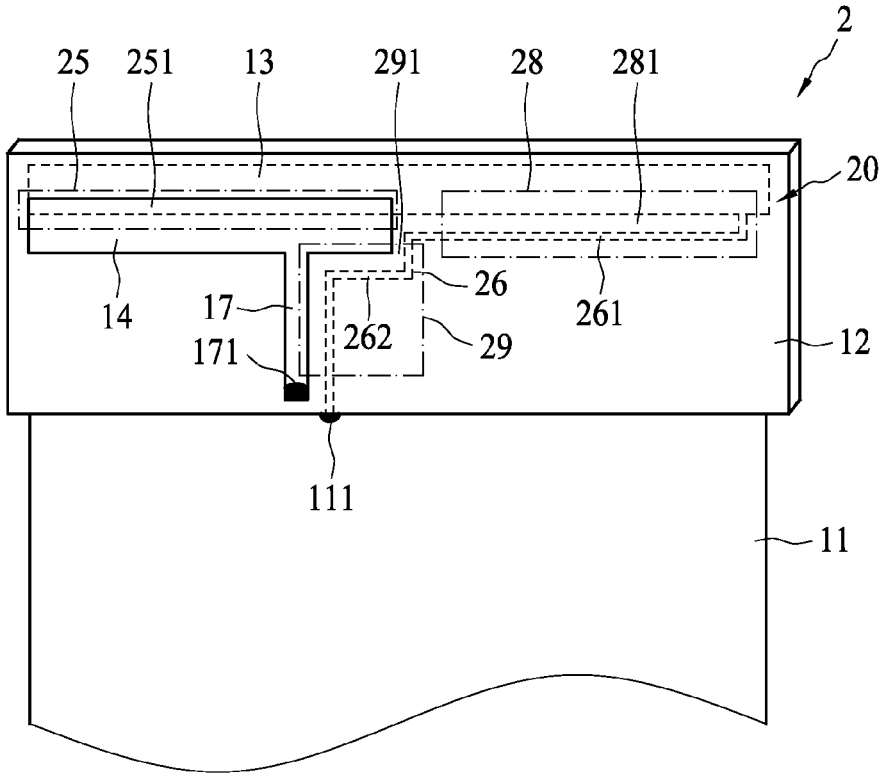
FIG. 3 illustrates a schematic view of another embodiment of the mobile communication device 2.

FIG. 3 shows a schematic view of another exemplary embodiment of the mobile communication device 2. The mobile communication device 2 includes a ground plane 11 and an antenna 20. The ground plane 11 has a grounding point 111. The antenna 20 comprises a radiating metal portion 13, a coupling metal portion 14, and an inductive shorting metal portion 26. The radiating metal portion 13 is coupled to the coupling metal portion 14 to form a first coupling portion 25 having a coupling slit 251. In other words, the first coupling portion 25 includes at least one coupling slit 251. The coupling metal portion 14 is electrically connected to the connecting metal strip 17. One end 171 of the connecting metal strip 17 is electrically connected to a source (not shown). One end of the inductive shorting metal portion 26 is electrically connected to the radiating metal portion 13, while the other end of the inductive shorting metal portion 26 is electrically connected to the grounding point 111 of the ground plane 11. The inductive shorting metal portion 26 includes a first fractional section 261 coupled to the radiating metal portion 13 to form a second coupling portion 28 having a coupling slit 281, and a second fractional section 262 coupled to the coupling metal portion 14 to form a third coupling portion 29 having a coupling slit 291. The major difference between the mobile communication device 1 and the mobile communication device 2 is that the radiating metal portion 13 and the coupling metal portion 14 of the mobile communication device 2 are disposed on opposite surfaces of the dielectric substrate 12, wherein the radiating metal portion 13 and the coupling metal portion 14 partially overlap to form an overlapped portion, which could be a coupling area. The thickness of the dielectric substrate 12 could be the gap of the coupling slit 251 of the first coupling portion 25. However, the first coupling portion 25 could also provide coupling effects similar to the coupling effects provided by the first coupling portion 15 of the mobile communication device 1. Therefore, the antenna performance similar to that provided by the mobile communication device 1 shown in FIG. 1 could also be achieved by the mobile communication device 2.

Figure 4:
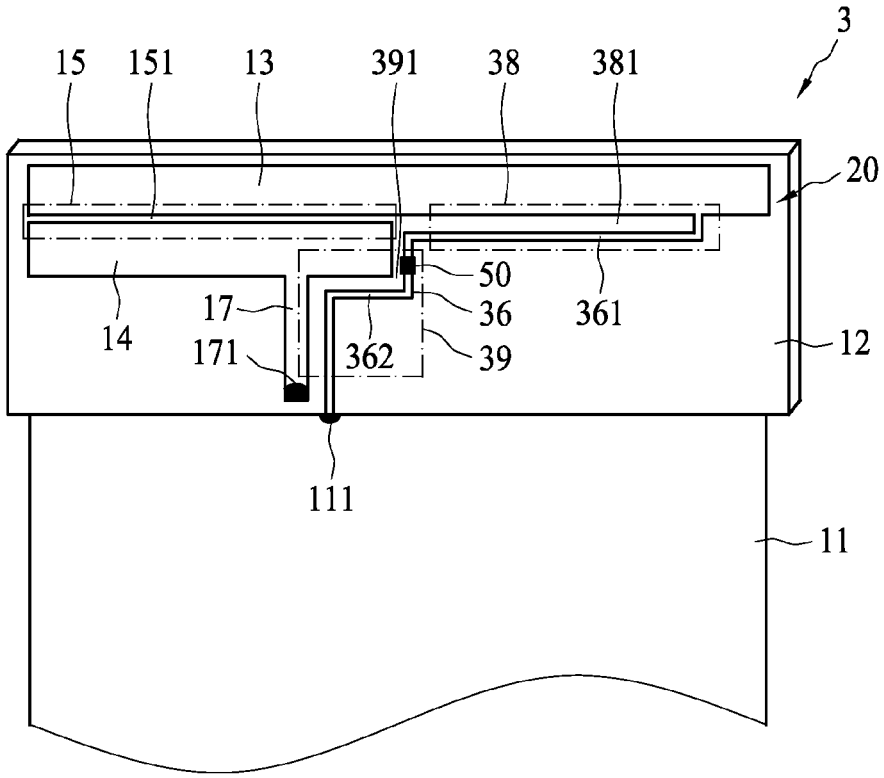
FIG. 4 illustrates a schematic view of another embodiment of the mobile communication device 3.

FIG. 4 illustrates a schematic view of another exemplary embodiment of the mobile communication device 3. The mobile communication device 3 includes a ground plane 11 and an antenna 20. The ground plane 11 has a grounding point 111. The antenna 20 comprises a radiating metal portion 13, a coupling metal portion 14, and an inductive shorting metal portion 36. The radiating metal portion 13 is capacitively coupled to the coupling metal portion 14 to form a first coupling portion 15 having a coupling slit 151. The coupling metal portion 14 is electrically connected to the connecting metal strip 17. One end 171 of the connecting metal strip 17 is electrically connected to a source (not shown). One end of the inductive shorting metal portion 36 is electrically connected to the radiating metal portion 13, while the other end of the inductive shorting metal portion 36 is electrically connected to the grounding point 111 of the ground plane 11. Besides, a chip inductor 50 is integrated with the inductive shorting metal portion 36. The inductive shorting metal portion 36 also includes a first fractional section 361 coupled to the radiating metal portion 13 to form a second coupling portion 38 having a coupling slit 381, and a second fractional section 362 coupled to the coupling metal portion 14 to form a third coupling portion 39 having a coupling slit 391. The major difference between the mobile communication device 1 and mobile communication device 3 is that there is an additional chip inductor 50 to be integrated with the inductive shorting metal portion 36. Due to the inductance provided by the chip inductor 50, it could efficiently shorten the required length of the inductive shorting metal portion 36. However, the second coupling portion 38 and the third coupling portion 39 could also provide coupling effects similar to the coupling effects provided by the second coupling portion 18 and the third coupling portion 19 of the mobile communication device 1 shown in FIG. 1, respectively. Therefore, the antenna performance similar to that provided by the mobile communication device 1 shown in FIG. 1 could also be achieved by the mobile communication device 3.

Figure 5:
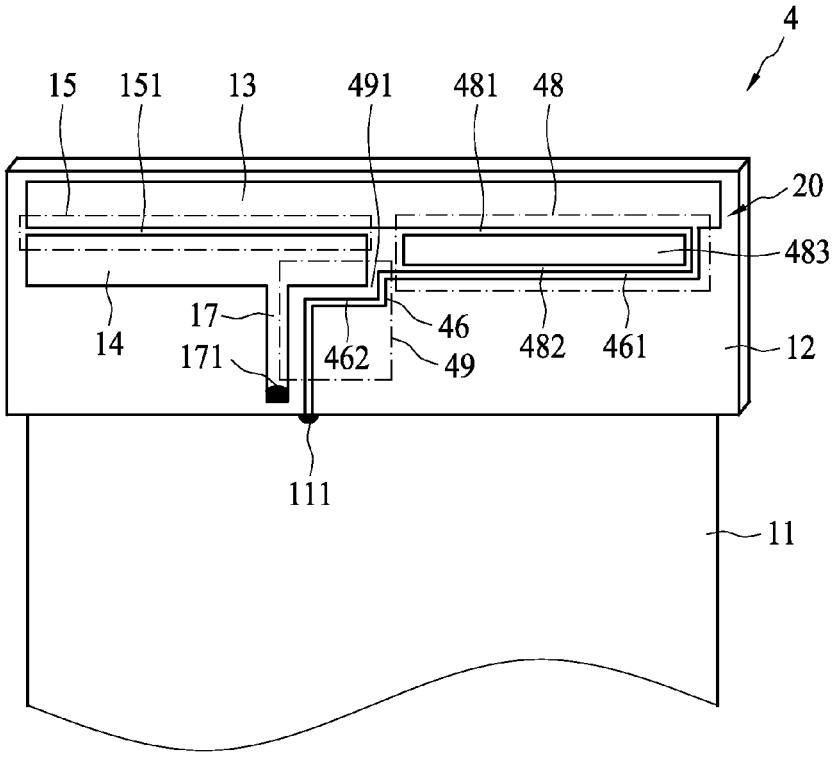
FIG. 5 illustrates a schematic view of another embodiment of the mobile communication device 4.

FIG. 5 illustrates a schematic view of another exemplary embodiment of the mobile communication device 4. The mobile communication device 4 includes a ground plane 11 and an antenna 20. The ground plane 11 has a grounding point 111. The antenna 20 comprises a radiating metal portion 13, a coupling metal portion 14, and an inductive shorting metal portion 46. The radiating metal portion 13 is capacitively coupled to the coupling metal portion 14 to form a first coupling portion 15 having a coupling slit 151. The coupling metal portion 14 is electrically connected to the connecting metal strip 17. One end 171 of the connecting metal strip 17 is electrically connected to a source (not shown). One end of the inductive shorting metal portion 46 is electrically connected to the radiating metal portion 13, while the other end of the inductive shorting metal portion 46 is electrically connected to the grounding point 111 of the ground plane 11. The inductive shorting metal portion 46 includes a first fractional section 461 coupled to the radiating metal portion 13 through a metal plate 483 to form a second coupling portion 48 having coupling slits 481 and 482, and a second fractional section 462 coupled to the coupling metal portion 14 to form a third coupling portion 49 having a coupling slit 491. The major difference between the mobile communication device 1 and the mobile communication device 4 is that the second coupling portion 18 and the third coupling portion 19 are replaced by the second coupling portion 48 and the third coupling portion 49, respectively. However, the second coupling portion 48 and the third coupling portion 49 could also provide coupling effects similar to the coupling effects provided by the second coupling portion 18 and the third coupling portion 19 of the mobile communication device 1. Therefore, the antenna performance similar to that provided by the mobile communication device 1 shown in FIG. 1 could also be achieved by the mobile communication device 4.

Figure 6:
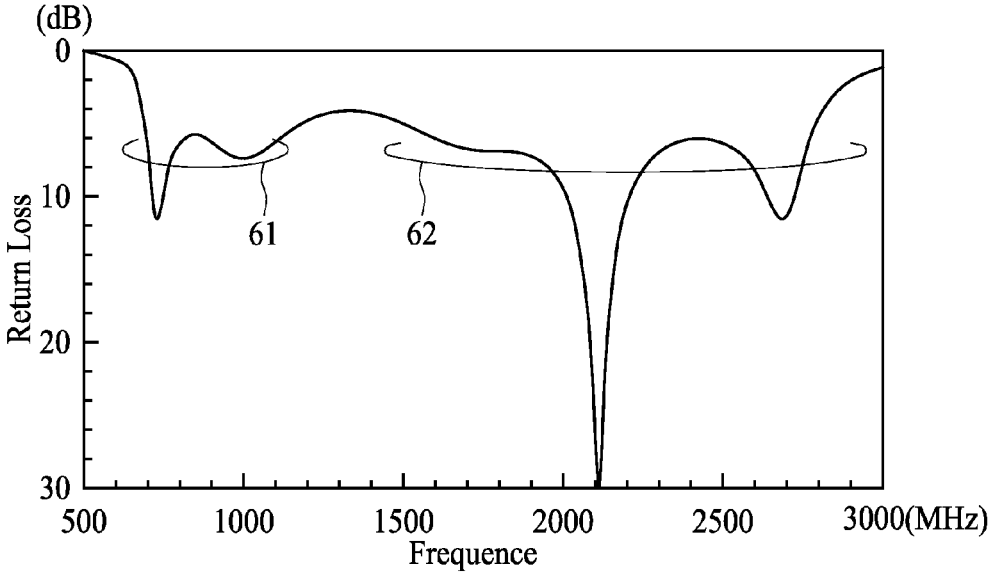
FIG. 6 illustrates a diagram of measured return loss of the mobile communication device 4 shown in FIG. 5.

FIG. 6 illustrates a view of measured return loss of the mobile communication device 4 as shown in FIG. 5. In this exemplary embodiment, dimensions of components of the mobile communication device 4 are as follows:

The length of the ground plane 11 is about 100 mm, the width of the ground plane 11 is about 45 mm; the height, width, and thickness of the dielectric substrate 12 are about 15 mm, 45 mm, and 0.8 mm, respectively; the length of the radiating metal portion 13 is about 45 mm, the width of the radiating metal portion 13 is about 3 mm, wherein the length of the radiating metal portion 13 is smaller than one-sixth of the wavelength of the lowest operating frequency (698 MHz) of the first operating band 61 of the antenna 20; the length of the coupling metal portion 14 is about 22 mm, the width of the coupling metal portion 14 is about 3 mm, wherein the length of the coupling metal portion 14 is about half the length of the radiating metal portion 13. The length of the coupling metal portion 14 could be further reduced, but the length of the coupling metal portion 14 should be greater than one-third of the length of the radiating metal portion 13 to achieve a wider operating bandwidth for the first operating band 61. The gap of the coupling slit 151 between the coupling metal portion 14 and the radiating metal portion 13 is about 1 mm. The gap of the coupling slit 151 should be less than or equal to one percent of the wavelength of the lowest operating frequency of the first operating band 61. The length of the inductive shorting metal portion 46 is about 37 mm; its length could be further reduced, but it should be at least half the length of the radiating metal portion 13 so as to provide sufficient inductance for the antenna 20, so that several excited higher-order resonant modes of the antenna 20 could be effectively frequency down-shifted. The width of the inductive shorting metal portion 46 is about 0.5 mm. The smaller width of the inductive shorting metal portion 46 could reduce the required length of the inductive shorting metal portion 46 to obtain a smaller antenna size and provide higher inductance for the antenna 20. By inserting a metal plate 483, whose length and width are about 20 mm and 2 mm, respectively, between the first fractional section 461 of the inductive shorting metal portion 46 and the radiating metal portion 13, the coupling slits 481 and 482 are formed. The gaps of the coupling slits 481 and 482 are about 1 mm to form a part of second coupling portion 48 and provide sufficient capacitive coupling for the antenna 20. The gaps of the coupling slits 481 and 482 should be less than or equal to one percent of the wavelength of the lowest operating frequency of the first operating band 61 so as to provide sufficient capacitive coupling for the antenna 20. The length of the first fractional section 461 is about 20 mm. The length of the first fractional section 461 should be longer than one-fifth of the length of the radiating metal portion 13 so as to allow the second coupling portion 48 to form sufficient coupling so that a more uniform surface current distribution on the radiating metal portion 13 could be obtained to further enhance the operating bandwidth of the resonant modes of the antenna 20. The gap of the coupling slit 491 between the second fractional section 462 of the inductive shorting metal portion 46 and the coupling metal portion 14 is about 1 mm. The gap of the coupling slit 491 should be less than or equal to one percent of the wavelength of the lowest operating frequency of the first operating band 61 so as to improve the impedance matching of the antenna 20. The length of the connecting metal strip 17 is about 8.5 mm, and the width of the connecting metal strip 17 is about 1.5 mm. In view of the experimental result, based on the definition of 6 dB return loss acceptable for practical application, the first operating band 61 is capable of covering three operating bands, including the LTE700/GSM850/GSM900 bands (698~787/824~894/880~960 MHz). The second operating band 62 is capable of covering five operating bands, including GSM1800/GSM1900/UMTS/LTE2300/LTE2500 bands (1710~1880/1850~1990/1920~2170/2300~2400/2500~2690 MHz), so that the antenna 20 of the mobile communication device 4 could cover eight operating bands for the LTE/GSM/UMTS operation.

Figure 7:
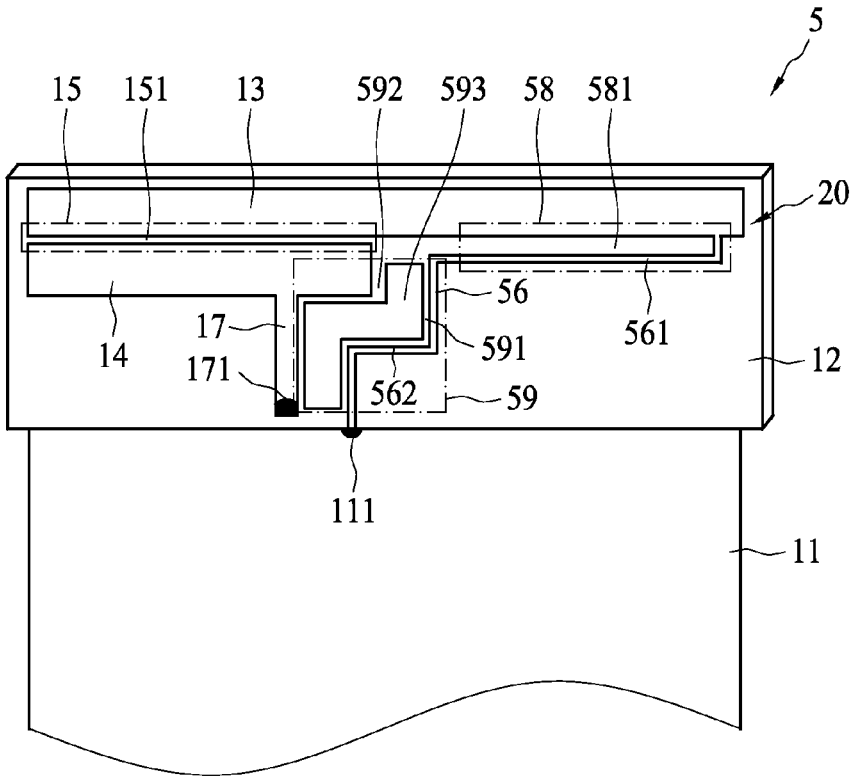
FIG. 7 illustrates a schematic view of another embodiment of the mobile communication device 5.

FIG. 7 illustrates a schematic view of another exemplary embodiment of the mobile communication device 5. The mobile communication device 5 includes a ground plane 11 and an antenna 20. The ground plane 11 has a grounding point 111. The antenna 20 comprises a radiating metal portion 13, a coupling metal portion 14, and an inductive shorting metal portion 56. The radiating metal portion 13 is capacitively coupled to the coupling metal portion 14 to form a first coupling portion 15 having a coupling slit 151. The coupling metal portion 14 is electrically connected to the connecting metal strip 17. One end 171 of the connecting metal strip 17 is electrically connected to a source (not shown). One end of the inductive shorting metal portion 56 is electrically connected to the radiating metal portion 13, while the other end of the inductive shorting metal portion 56 is electrically connected to the grounding point 111 of the ground plane 11. The inductive shorting metal portion 56 includes a first fractional section 561 coupled to the radiating metal portion 13 to form a second coupling portion 58 having a coupling slit 581, and a second fractional section 562 coupled to the coupling metal portion 14 through a metal plate 593 to form a third coupling portion 59 having coupling slits 591 and 592. The major difference between the mobile communication device 1 and the mobile communication device 5 is that the third coupling portion 19 is replaced by the third coupling portion 59. However, the third coupling portion 59 of the mobile communication device 5 could also provide the coupling effect similar to the coupling effect provided by the third coupling portion 19 of the mobile communication device 1. Therefore, the antenna performance similar to that provided by the mobile communication device 1 shown in FIG. 1 could also be achieved by the mobile communication device 5.

Figure 8:
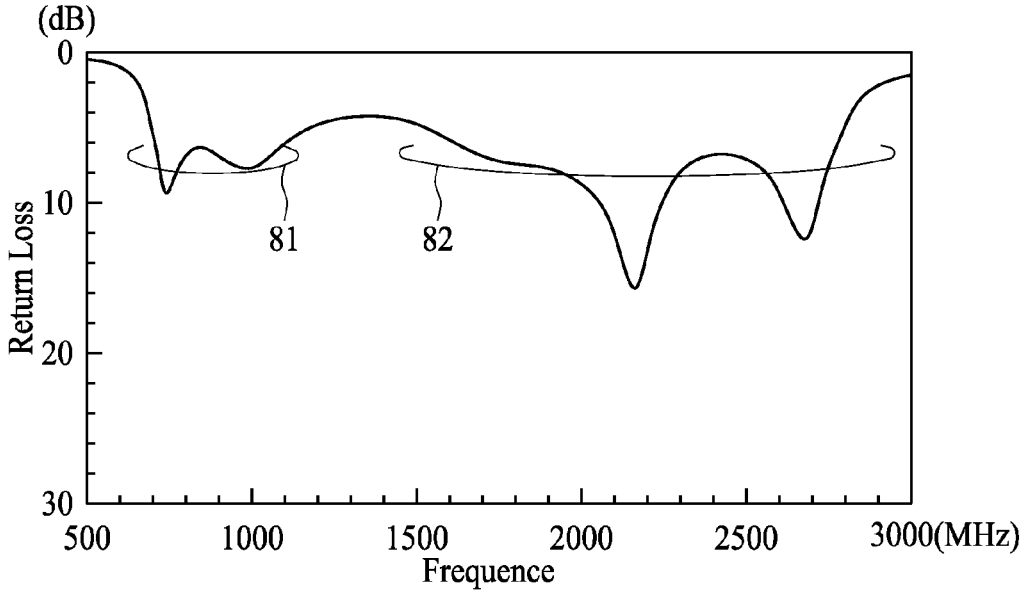
FIG. 8 illustrates a diagram of measured return loss of the mobile communication device 5 shown in FIG. 7.

FIG. 8 illustrates a diagram of measured return loss of the mobile communication device 5 as shown in FIG. 7. In this exemplary embodiment, dimensions of components of the mobile communication device 5 are as follows:

The length of the ground plane 11 is about 100 mm; the width of the ground plane 11 is about 45 mm; the height, width, and thickness of the dielectric substrate 12 are about 15 mm, 45 mm, and 0.8 mm, respectively; the length of the radiating metal portion 13 is about 45 mm, the width of the radiating metal portion 13 is about 3 mm, wherein the length of the radiating metal portion 13 is less than one-sixth of the wavelength of the lowest operating frequency (698 MHz) of the first operating band 81 of the antenna 20; the length of the coupling metal portion 14 is about 22 mm, the width of the coupling metal portion 14 is about 3 mm, wherein the length of the coupling metal portion 14 is about half the length of the radiating metal portion 13. The length of the coupling metal portion 14 could be further reduced, but the length of the coupling metal portion 14 should be greater than one-third of the length of the radiating metal portion 13 to achieve a wider operating bandwidth for the first operating band 81. The gap of the coupling slit 151 between the coupling metal portion 14 and the radiating metal portion 13 is about 1 mm. The gap of the coupling slit 151 should be less than or equal to one percent of the wavelength of the lowest operating frequency of the first operating band 81. The length of the inductive shorting metal portion 56 is about 37 mm; its length could be further reduced, but it should be at least half the length of the radiating metal portion 13 so as to provide sufficient inductance for the antenna 20, so that several excited higher-order resonant modes of the antenna 20 could be effectively frequency down-shifted. The width of the inductive shorting metal portion 56 is about 0.5 mm. The smaller width of the inductive shorting metal portion 56 could reduce the required length of the inductive shorting metal portion 56 to obtain a smaller antenna size and provide higher inductance for the antenna 20. The gap of the coupling slit 581 is about 1 mm. The gap of the coupling slit 581 should be less than or equal to one percent of the wavelength of the lowest operating frequency of the first operating band 81. The length of the first fractional section 561 is about 20 mm. The length of the first fractional section 561 should be greater than one-fifth of the length of the radiating metal portion 13 so as to allow the second coupling portion 58 to form sufficient coupling so that a more uniform surface current distribution on the radiating metal portion 13 could be obtained to further enhance the bandwidth of the resonant modes of the antenna 20. By inserting a metal plate 593 between the second fractional section 562 of the inductive shorting metal portion 56 and the coupling metal portion 14, the coupling slits 591 and 592 are formed. The gaps of the coupling slits 591 and 592 are about 1 mm to provide sufficient capacitive coupling for the antenna 20. The gaps of the coupling slits 591 and 592 should be less than or equal to one percent of the wavelength of the lowest operating frequency of the first operating band 81 to improve the impedance matching of the resonant modes of the antenna 20. The length of the connecting metal strip 17 is about 8.5 mm, and the width of the connecting metal strip 17 is about 1.5 mm. In view of the experimental result, based on the definition of 6 dB return loss acceptable for practical application, the first operating band 81 is capable of covering three operating bands, including the LTE700/GSM850/GSM900 bands (698~787/824~894/880~960 MHz). The second operating band 82 is capable of covering five bands, including GSM1800/GSM1900/UMTS/LTE2300/LTE2500 bands (1710~1880/1850~1990/1920~2170/2300~2400/2500~2690 MHz), so that the antenna 20 of the mobile communication device 5 could cover eight operating bands for the LTE/GSM/UMTS operation.

Figure 9:
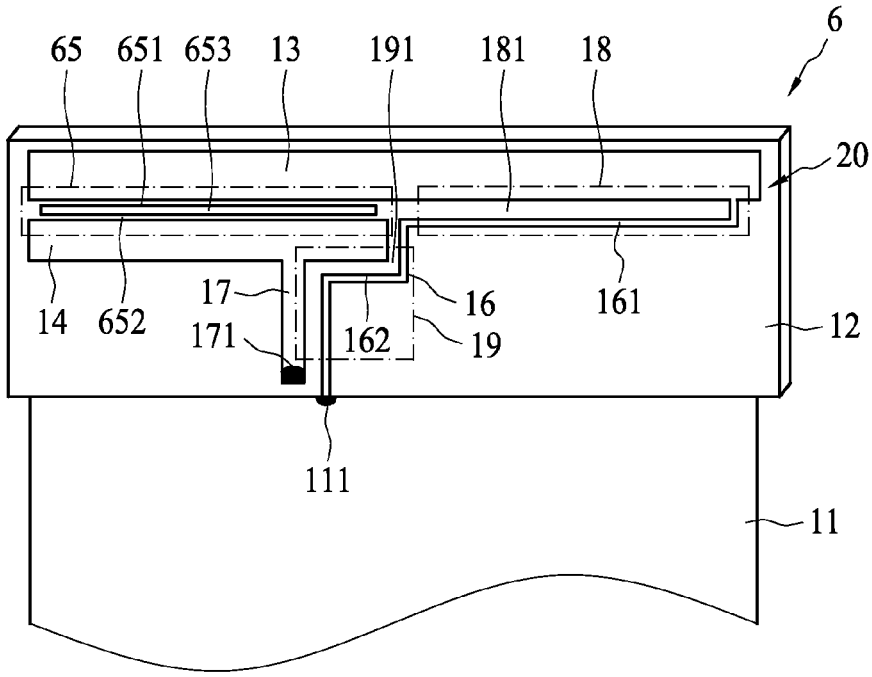
FIG. 9 illustrates a schematic view of another embodiment of the mobile communication device 6.

FIG. 9 illustrates a schematic view of another exemplary embodiment of the mobile communication device 6. The mobile communication device 6 includes a ground plane 11 and an antenna 20. The ground plane 11 has a grounding point 111. The antenna 20 comprises a radiating metal portion 13, a coupling metal portion 14, and an inductive shorting metal portion 16. The radiating metal portion 13 is capacitively coupled to the coupling metal portion 14 through a metal plate 653 to form a first coupling portion 65 having coupling slits 651 and 652. In other words, the first coupling portion 65 includes coupling slits 651 and 652. The coupling metal portion 14 is electrically connected to the connecting metal strip 17. One end 171 of the connecting metal strip 17 is electrically connected to a source (not shown). One end of the inductive shorting metal portion 16 is electrically connected to the radiating metal portion 13, while the other end of the inductive shorting metal portion 16 is electrically connected to the grounding point 111 of the ground plane 11. The inductive shorting metal portion 16 includes a first fractional section 161 coupled to the radiating metal portion 13 to form a second coupling portion 18 having a coupling slit 181, and a second fractional section 162 coupled to the coupling metal portion 14 to form a third coupling portion 19 having a coupling slit 191. The major difference between the mobile communication device 1 and the mobile communication device 6 is that the first coupling portion 15 is replaced by the first coupling portion 65. However, the first coupling portion 65 could provide the coupling effect similar to the coupling effect provided by the first coupling portion 15 of the mobile communication device 1. Therefore, the antenna performance similar to that provided by the mobile communication device 1 shown in FIG. 1 could also be achieved by the mobile communication device 6.

Figure 10:
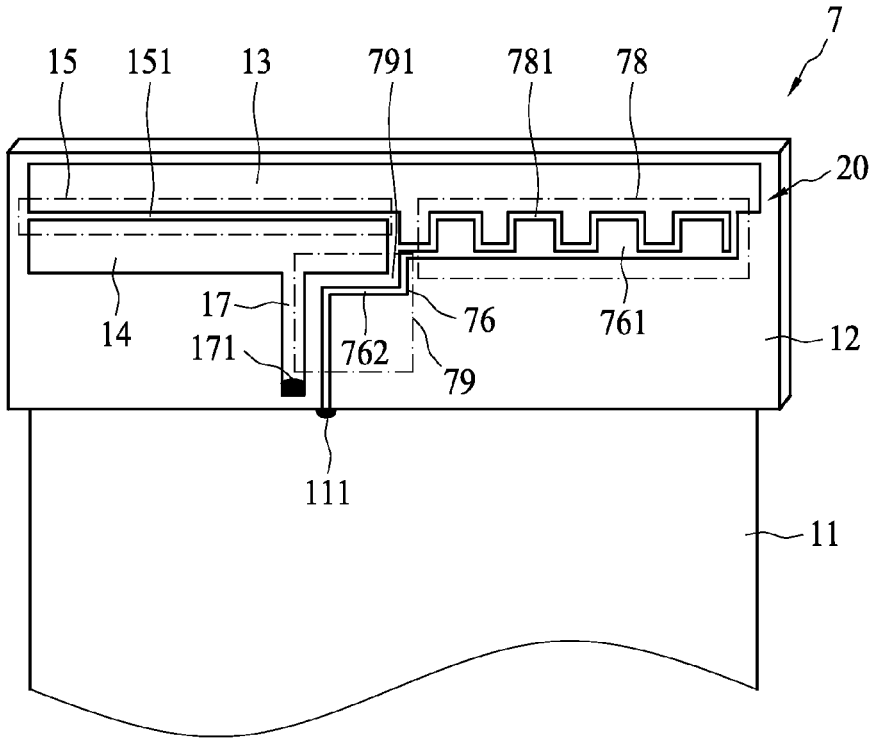
FIG. 10 illustrates a schematic view of another embodiment of the mobile communication device 7.

FIG. 10 illustrates a schematic view of another exemplary embodiment of the mobile communication device 7. The mobile communication device 7 includes a ground plane 11 and an antenna 20. The ground plane 11 has a grounding point 111. The antenna 20 comprises a radiating metal portion 13, a coupling metal portion 14, and an inductive shorting metal portion 76. The radiating metal portion 13 is capacitively coupled to the coupling metal portion 14 to form a first coupling portion 15 having a coupling slit 151. The coupling metal portion 14 is electrically connected to the connecting metal strip 17. One end 171 of the connecting metal strip 17 is electrically connected to a source (not shown). One end of the inductive shorting metal portion 76 is electrically connected to the radiating metal portion 13, while the other end of the inductive shorting metal portion 76 is electrically connected to the grounding point 111 of the ground plane 11. The inductive shorting metal portion 76 includes a first fractional section 761 coupled to the radiating metal portion 13 to form a second coupling portion 78 having a zigzag slit 781, and a second fractional section 762 coupled to the coupling metal portion 14 to form a third coupling portion 79 having a coupling slit 791. The major difference between the mobile communication device 1 and the mobile communication device 7 is that the shape of the coupling slit 781 is different from the shape of the coupling slit 181 of the mobile communication device 1. However, the second coupling portion 78 could also provide the coupling effect similar to the coupling effect provided by the second coupling portion 18 of the mobile communication device 1. Therefore, the antenna performance similar to that provided by the mobile communication device 1 shown in FIG. 1 could also be achieved by the mobile communication device 7.

In certain exemplary embodiments of mobile communication devices, by configuring the radiating metal portion to be coupled to the coupling metal portion whose length is no less than one-third of the length of the radiating metal portion, the first coupling portion could be formed as a capacitively coupled feed for the antenna. With sufficient length of the coupling metal portion, a more uniform current distribution could be obtained at the antenna's feed portion to efficiently decrease the high impedance level of the antenna's lowest resonant mode; hence the center frequency of the lowest resonant mode of the antenna would be less than the center frequency of the general quarter-wavelength resonant mode. Besides, the capacitively coupled feed could provide sufficient capacitive reactance to compensate for the high inductive reactance of the lowest resonant mode of the antenna. This enables the radiating metal portion to efficiently excite the first operating band with a wide operating bandwidth to cover three operating bands, including the LTE700/GSM850/GSM900 bands (698~787/824~894/880~960 MHz). The length of the radiating metal portion is less than one sixth of the wavelength of the lowest operating frequency of the first operating band. The inductive shorting metal portion having length no less than half the length of the radiating metal portion short-circuits the radiating metal portion to the ground plane. The narrow inductive shorting metal portion could provide high inductance to be able to efficiently downshift several higher-order resonant modes of the antenna. The inductive shorting metal portion includes a first fractional section coupled to the radiating metal portion to form a second coupling portion. The coupling effect formed by the second coupling portion could induce a more uniform current distribution to be obtained on the radiating metal portion to effectively increase the impedance bandwidth of the antenna. Moreover, more usable area for disposing other components in the mobile communication device could be obtained between the inductive shorting metal portion and the ground plane by configuring the second coupling portion. The inductive shorting metal portion further includes a second fractional section coupled to the coupling metal portion to form a third coupling portion. The coupling effect formed by the third coupling portion could improve the impedance matching of several higher-order resonant modes of the antenna to generate a second operating band with wide operating bandwidth, which could cover five operating bands, including GSM1800/GSM1900/UMTS/LTE2300/LTE2500 bands (1710~1880/1850~1990/1920~2170/2300~2400/2500~2690 MHz). Therefore, the present invention discloses that the antenna of the mobile communication device could provide two wide operating bands for the LTE/GSM/UMTS operation.

The above-described exemplary embodiments are intended to be illustrative only. Those skilled in the art may devise numerous alternative embodiments without departing from the scope of the following claims.

We claim:

1. A mobile communication device including a ground plane and an antenna disposed on a dielectric substrate, the antenna comprising:

a radiating metal portion providing a resonant path for the antenna to generate a first operating band and a second operating band, wherein operating frequencies of the first operating band are lower than operating frequencies of the second operating band;

a coupling metal portion coupled to the radiating metal portion to form a first coupling portion, wherein the coupling metal portion is electrically connected to a source through a connecting metal strip and the coupling metal portion capacitively couples electromagnetic energy to the radiating metal portion through the first coupling portion; and an inductive shorting metal portion having a length no less than one-half the length of the radiating metal portion, wherein one end of the inductive shorting metal portion is electrically connected to the radiating metal portion, another end of the inductive shorting metal portion is electrically connected to the ground plane, the inductive shorting metal portion includes a first fractional section coupled to the radiating metal portion to form a second coupling portion, and a second fractional section coupled to the coupling metal portion to form a third coupling portion, wherein a length of the coupling metal portion is no less than one-third of a length of the radiating metal portion.

2. The mobile communication device of claim 1, wherein the length of the radiating metal portion is less than one-sixth of a wavelength of a lowest operating frequency of the first operating band.

3. The mobile communication device of claim 1, wherein the first coupling portion includes at least one coupling slit.

4. The mobile communication device of claim 3, wherein a gap of the coupling slit is less than or equal to one percent of a wavelength of a lowest operating frequency of the first operating band.

5. The mobile communication device of claim 1, wherein the first coupling portion includes at least one coupling slit and at least one metal plate.

6. The mobile communication device of claim 5, wherein a gap of the coupling slit is less than or equal to one percent of a wavelength of a lowest operating frequency of the first operating band.

7. The mobile communication device of claim 1, wherein the first coupling portion provides capacitive coupling.

8. The mobile communication device of claim 1, wherein the second coupling portion includes at least one coupling slit.

9. The mobile communication device of claim 8, wherein a gap of the coupling slit is less than or equal to one percent of a wavelength of a lowest operating frequency of the first operating band.

10. The mobile communication device of claim 1, wherein the second coupling portion includes at least one coupling slit and at least one metal plate.

11. The mobile communication device of claim 10, wherein a gap of the coupling slit is less than or equal to one percent of a wavelength of a lowest operating frequency of the first operating band.

12. The mobile communication device of claim 1, wherein the second coupling portion provides capacitive coupling.

13. The mobile communication device of claim 1, wherein the third coupling portion includes at least one coupling slit.

14. The mobile communication device of claim 13, wherein a gap of the coupling slit is less than or equal to one percent of a wavelength of a lowest operating frequency of the first operating band.

15. The mobile communication device of claim 1, wherein the third coupling portion includes at least one coupling slit and at least one metal plate.

16. The mobile communication device of claim 15, wherein a gap of the coupling slit is less than or equal to one percent of a wavelength of a lowest operating frequency of the first operating band.

17. The mobile communication device of claim 1, wherein the third coupling portion provides capacitive coupling.

18. The mobile communication device of claim 1, wherein the radiating metal portion and the coupling metal portion are disposed on the same surface of the dielectric substrate.

19. The mobile communication device of claim 1, wherein the radiating metal portion and the coupling metal portion are disposed on opposite surfaces of the dielectric substrate.

20. The mobile communication device of claim 1, wherein the inductive shorting metal portion includes a chip inductor.

21. The mobile communication device of claim 1, wherein the inductive shorting metal portion includes a bending structure.

* * * * *